US005277101A

United States Patent [19]

Matsuki et al.

[11] Patent Number: 5,277,101

[45] Date of Patent: Jan. 11, 1994

[54] RODLESS CYLINDER APPARATUS

[75] Inventors: Yuji Matsuki, Sayama; Wataru Ichikawa, Tokyo; Shigeo Tsuru; Yoshifumi Umemura, both of Toyota, all of Japan

[73] Assignee: Kabushiki Kaisha SG, Tokyo, Japan

[21] Appl. No.: 883,290

[22] Filed: May 14, 1992

[30] Foreign Application Priority Data

May 17, 1991 [JP] Japan ..... 3-140638

[51] Int. Cl.[5] ..... F01B 31/12

[52] U.S. Cl. ..... 92/5 L; 92/18; 92/24; 92/88; 92/165 R

[58] Field of Search ..... 92/5 R, 5 L, 18, 24, 92/27, 28, 88, 107, 165; 244/63

[56] References Cited

U.S. PATENT DOCUMENTS

| | | | |
|---|---|---|---|
| 2,473,430 | 6/1949 | Hoffar . | |
| 3,176,590 | 4/1965 | Uhtenwoldt et al. | 92/28 |
| 3,454,242 | 7/1969 | Feder et al. | 92/88 |
| 4,744,287 | 5/1988 | Miyamoto | 92/5 R |
| 4,804,913 | 2/1989 | Shimizu et al. | 92/5 R |
| 4,819,546 | 4/1989 | Ernst et al. | 92/5 R |
| 5,111,913 | 5/1992 | Granbom | 92/88 |

FOREIGN PATENT DOCUMENTS

| | | |
|---|---|---|
| 2908605 | 9/1980 | Fed. Rep. of Germany . |
| 62-180104 | 8/1987 | Japan . |

*Primary Examiner*—Edward K. Look
*Assistant Examiner*—F. Daniel Lopez
*Attorney, Agent, or Firm*—Graham & James

[57] ABSTRACT

The rodless cylinder includes at least a cylinder tube and a piston, but it has no piston rod that is indispensable in the conventional cylinders. The article carrier is connected via the piston yoke to the piston and movable with parts and jigs placed thereon as the piston moves along the cylinder. At least one rod is fixed relative to the cylinder tube to extend in parallel with the direction in which the piston and hence the carrier moves. The sensor is provided to be movable along the rod as the piston moves. The sensor has a moving member movable along the rod as the piston moves within the cylinder tube, for detecting a current position of the piston in accordance with relative positional relation between the moving member and the rod. With such arrangements, the rodless cylinder as a whole has a higher rigidity against heavy load, and also the piston can be accurately positioned to stop at a desired position in its stroke.

8 Claims, 8 Drawing Sheets

RODLESS CYLINDER APPARATUS

BACKGROUND OF THE INVENTION

This invention generally relates to a rodless cylinder apparatus which permits movement of a piston within a cylinder tube without employing a piston rod, and more particularly to a rodless cylinder apparatus which is capable of positioning the piston at a desired position in its stroke within the cylinder.

As most typically represented by an air cylinder, cylinders are widely used as an actuator for positioning various parts and jigs placed on a table at a selected or desired position. In general, each of the cylinders comprise a cylinder tube, a piston provided within the cylinder tube for reciprocating movement therealong, and a piston rod for transmitting the reciprocating movement of the piston to an external element.

It is known that a cylinder having a piston rod requires a cylinder tube which is at least as long as the stroke over which the piston rod makes a reciprocating movement. This presents a problem that the longer the stroke length is, the bigger space is needed for installation of the cylinder.

Because of the above-noted problem, a rodless cylinder has become more popular in recent years which allows a piston to make a reciprocating movement without employing a piston rod. Having no piston rod, such rodless cylinder can be installed in much smaller space as compared with the traditional cylinders having a piston rod.

FIGS. 7, 8 and 9 illustrate an example of the prior art rodless cylinder in trigonometry: FIG. 7 is a plan view of the rodless cylinder as viewed in the Z-axis direction; FIG. 8 is a side-elevational view of the rodless cylinder as viewed in the Y-axis direction, and FIG. 9 is a side-elevational view of the rodless cylinder as viewed in the X-axis direction (that is, the piston movement direction). In FIGS. 8 and 9, the rodless cylinder is shown partly in cross section.

A cylinder tube 1*a* of the cylinder is in a rectangular parallelepiped shape, and it has a hollow interior portion that serves as a guide along which piston 2*a* makes an reciprocating movement. The cylinder tube 1*a* also has a longitudinal gap of a given width which extends in the axial direction of the tube 1*a* along the entire stroke, namely, length of the reciprocating movement of the piston 2*a*, in order to allow a piston yoke 2*b* to project outwardly of the tube 1*a* and to move freely along the tube 1*a*. Because of the gap, the cylinder tube 1*a* is generally C-shaped in cross section as viewed in the piston movement direction (X-axis direction). The gap in the cylinder tube 1*a* is sealed by a sealing belt 5 for fluid tightness in the tube 1*a*.

The piston 2*a* is composed of right and left pistons 2*a* each of which is a cylindrical column that corresponds in cross-sectional shape to the hollow interior portion of the cylinder tube 1*a*. The piston yoke 2*b* has an upper portion projecting outwardly of the cylinder tube 1*a* and terminating in a support portion for supporting thereon a table or article carrier 6. Within the cylinder tube 1*a*, the pistons 2*a* are coupled to the left and right side of the yoke 2*b* respectively. A piston packing 3 is provided on and around the outer circumferential surface of the piston 2*a*. In the piston yoke 2*b*, a slot 4 is provided through which the sealing belt 5 extends. The sealing belt 5 is movable relative to the yoke 2*b* along the slot 4, so that the yoke 2*b* is capable of making a free reciprocating movement with the piston 2*a* while fluid tightness in the tube 1*a* is maintained by means of the sealing belt 5.

The table 6 has a channel-shaped cross section and mounted on the upper support portion of the piston yoke 2*b*. The piston yoke 2*b* has in its upper surface a guide channel for a dustproof belt 7. The belt 7 is slidable along the guide channel of the piston yoke 2*b* between the table 6 and piston yoke 2*b*. The belt pressing member 8 is rotatably mounted about a shaft 9 and normally urged by a spring 10 for pressing the dustproof belt 7 against a wall defining the gap of the cylinder tube 1*a*.

End caps 11L and 11R are provided at opposite ends of the cylinder tube 1*a* and have air supplying tubes 11*a* and 11*b*, respectively, for supplying pressurized air into the cylinder tube 1*a*. Belt covers 12L and 12R are provided for fastening the dustproof belt 7 and sealing belt 5 at the opposite ends of the cylinder tube 1*a*. The end cap 11L, cylinder tube 1*a*, sealing belt 5 and left piston 2*a* together form a left-side chamber space, while the end cap 11R, cylinder tube 1*a*, sealing belt 5 and right piston 2*a* together form a right-side chamber space.

When a predetermined amount of pressurized air is supplied through the air supplying tube 11*a* into the left-side chamber space, air pressure in the left-side chamber space is increased so as to move the left piston 2*a* and piston yoke 2*b* together to the right. Conversely, when a predetermined amount of pressurized air is supplied through the air supplying tube 11*b* into the right-side chamber space, air pressure in the right-side chamber space is increased so as to move the right piston 2*a* and piston yoke 2*b* together to the left. This causes the table 6 to make a reciprocating movement along the length of the cylinder tube 1*a*.

Although not shown in the drawings, a magnet is provided near the outer periphery of a cylindrical portion of the piston yoke 2*b* and a proximity switch is provided on the side surface of the cylinder tube 1*a*. With such magnet and proximity switch, the stroke end of the cylinder can be detected and the reciprocating movement of the piston 2*a* can be controlled as desired.

The prior art rodless cylinder 1 shows relatively strong load-resistance characteristics against a vertical (Z-axis direction) load moment that is applied to the piston 2*a* via the table 6. But, the prior art rodless cylinder 1 shows relatively weak load-resistance characteristics against a vertical load that is applied to the piston yoke 2*b* from the table 6, because, as previously noted, the cylinder 1 has the gap extending along the entire length of the piston movement (X-axis direction) to allow the piston yoke 2*b* to project outwardly of the tube 1*a* and to move freely along the tube 1*a*.

In particular, the rodless cylinder 1 shows extremely weak characteristics against a laterally bending moment that is applied from the center of the piston yoke 2*b* in the Y-axis direction. The laterally bending moment is such a moment that will rotate the piston yoke 2*b* in the Y-Z plane. Hereinafter, a moment that will rotate the piston yoke 2*b* in the X-Z plane will be referred to as a bending moment, and a moment that will rotate the piston yoke 2*b* in the X-Y plane will be referred to as a twisting moment.

Accordingly, in the case where a robot or the like is constructed using a plurality of the prior art rodless cylinders 1 in such a manner that it is capable of making controlled free movements in two or three-dimentional coordinates space, the total weight of parts and jigs which can safely be placed on the table 6 will be undesirably limited because of the above-mentioned various moments produced due to the weight of the rodless cylinder 1 itself. This makes the robot or the like extremely impractical.

In addition, the prior art rodless cylinder 1 can only detect the stroke end of the piston 2*a* by means of the magnet incorporated in the piston 2*a* and the proximity switch, but it can not detect a current position of the stroke of the piston 2*a*, and so it can not achieve such a function to stop the piston 2*a* (i.e., table 6) accurately at a desired position (intermediate point) in the stroke. Although the piston 2*a* can be stopped at an intermediate position in the stroke by applying the equal air pressure to both sides of the piston 2*a* because air contact surfaces on both sides of the piston 2*a* are equal in area, stop position of the piston 2*a* can not be accurately controlled. In particular, in the case where plurality of the rodless cylinders 1 are employed to form two or three-dimensional space and the movement direction of the piston 2*a* happens to coincide with the gravity direction, it will be extremely difficult to stop the piston 2*a* (and hence table 6) accurately at a desired intermediate position in the stroke.

SUMMARY OF THE INVENTION

It is therefore a primary object of the present invention to provide a rodless cylinder apparatus which is highly rigid against heavy loads and is also capable of positioning a piston accurately at any desired position in its stroke.

A rodless cylinder apparatus according to the present invention comprises: a rodless cylinder including a cylinder tube, a piston movable within said cylinder tube and a connecting member connected to said piston, said cylinder tube having a longitudinal gap extending in an axial direction thereof, through which said connecting member projects outwardly of the cylinder so as to connect the carrier with said piston and is also allowed to move along said cylinder tube in such a manner that the carrier is moved together with said piston; at least a first rod fixed relative to said cylinder tube to extend in parallel with a direction in which said piston moves within said cylinder tube, said rod being provided in such a manner to support at least a part of weight of the carrier applied to said rodless cylinder; and a sensor having a moving member movable along said rod as said piston moves within said cylinder tube, for detecting a current position of said piston in accordance with relative positional relation between the moving member and the rod.

In general, the rodless cylinder comprises at least a cylinder tube and a piston but no piston rod that is indispensable in the conventional cylinders. The article carrier is connected via the connecting member to the piston and is movable with parts and jigs placed thereon as the piston moves along the cylinder tube. In the prior art rodless cylinder, weight of the table is applied to the piston yoke and piston.

In the present invention, the rod is fixed relative to the cylinder tube in such a manner that the rod extends in parallel with the direction in which the piston and hence the carrier moves along the cylinder tube. The sensor is provided to be movable along the rod as the piston moves for detecting the current position of the piston.

Since the rod is arranged to receive at least a part of weight of the carrier, the rod serves as a beam for supporting the carrier. Accordingly, much stronger load-resistance characteristics can be obtained as compared with the prior art rodless cylinders where weight of the carrier is received only by the piston yoke or connecting member, piston and cylinder tube. Only one such rod may be sufficient to enhance the load-resistance characteristics, but when higher performance is desired against a lateral bending moment, two such rods may be provided.

As noted above, the present invention can remarkably enhance load-resistance characteristics by providing the rod in such a manner to support weight of the carrier. Further, since the sensor is constructed using this rod, there will be achieved a superior advantage that the piston can be positioned to stop accurately at a desired position in its stroke.

Now, the preferred embodiment of the present invention will be described in greater detail with reference to the attached drawings.

DETAILED DESCRIPTION OF THE PREFERRED EMBODIMENT

Figure 1:
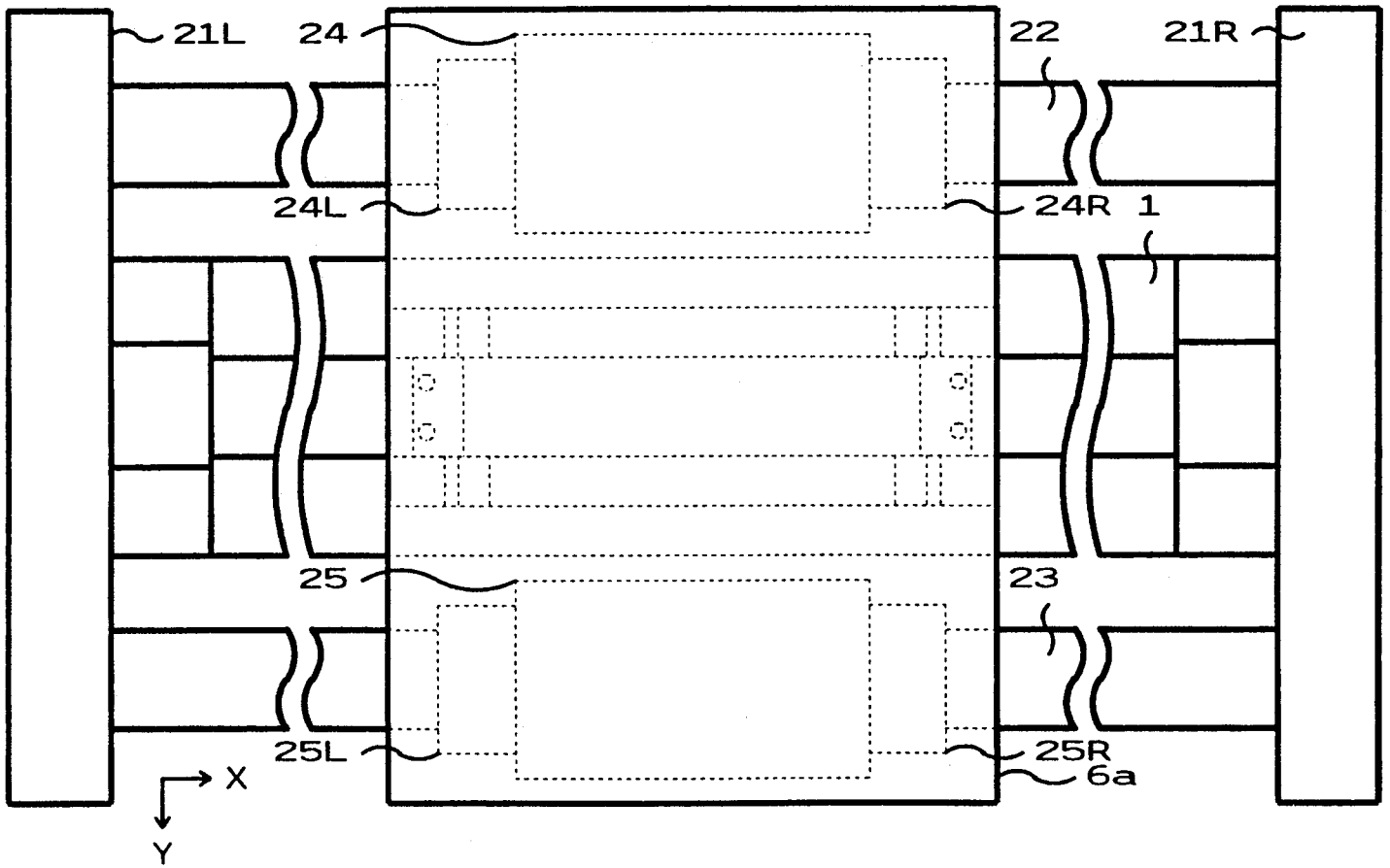
FIG. 1 is a top plan view of a rodless cylinder apparatus according to an embodiment of the present invention, as viewed in the Z-axis direction.
Figure 2:
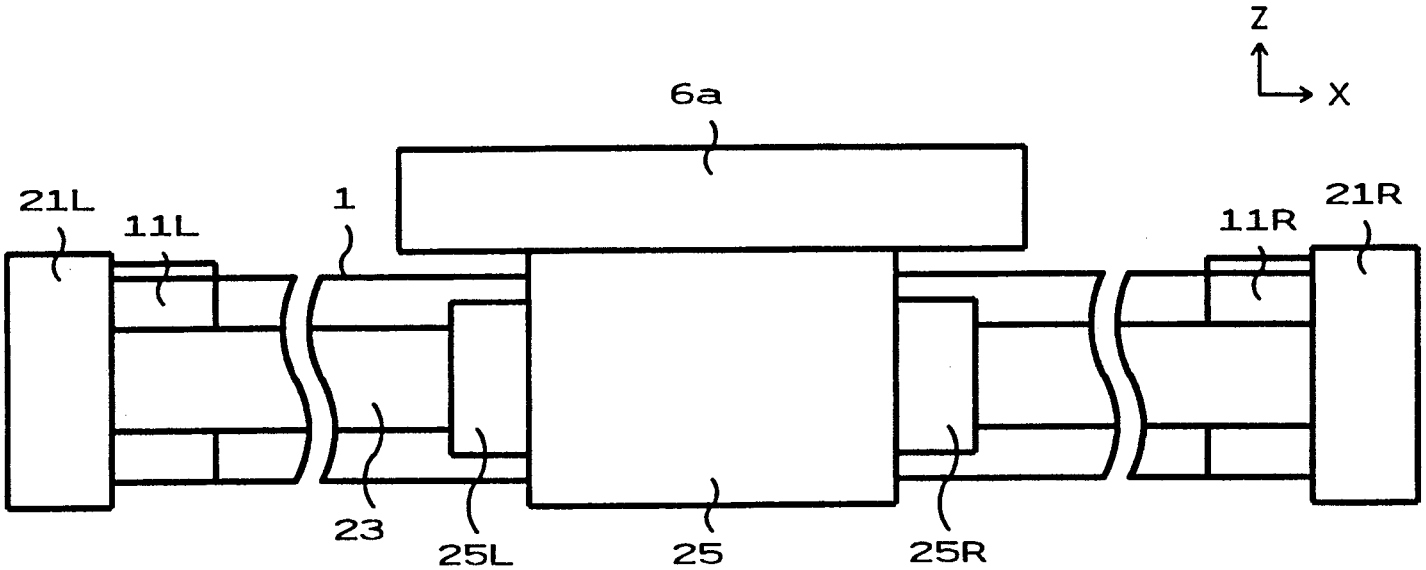
FIG. 2 is a side elevational view of the rodless cylinder apparatus as viewed in the Y-axis direction.
Figure 3:
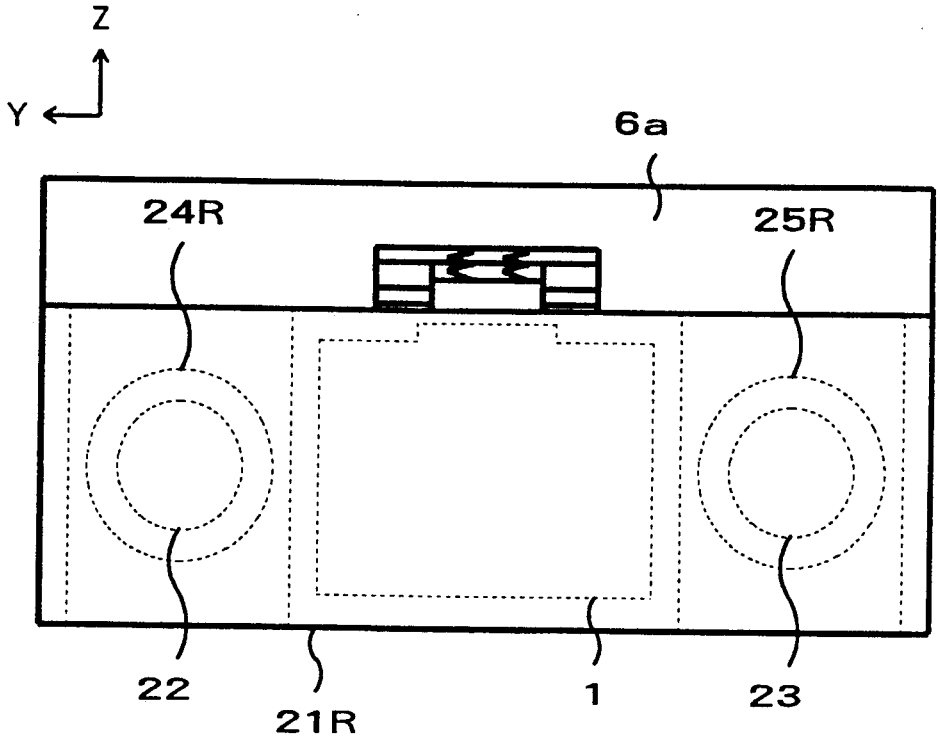
FIG. 3 is an end view of the rodless cylinder apparatus as viewed in the X-axis direction.

FIG. 1 shows in trigonometry a rodless cylinder apparatus according to an embodiment of the present invention. More particularly, FIG. 1 corresponds to FIG. 7 and is a top plan view of the rodless cylinder apparatus as viewed in the Z-axis direction. It is also to be noted that FIG. 2 corresponds to FIG. 8 and is a side elevational view of the rodless cylinder apparatus of FIG. 1 as viewed in the Y-axis direction, and FIG. 3 corresponds to FIG. 9 and is an end elevational view of the rodless cylinder apparatus of FIG. 1 as viewed in the X-axis direction.

The rodless cylinder apparatus generally comprises a conventional-type rodless cylinder 1, securing plates 21L, 21R, a brake rod 22, a sensor rod 23, brake 24 and sensor 25. The rodless cylinder 1 is identical in construction with the cylinder previously discussed in connection with FIGS. 7 to 9. The table 6a employed in this embodiment is larger in width than the conventional table 6 and extends to cover the brake 24 and sensor 25 as viewed from above (in the Z-axis direction). The table 6a is mechanically coupled to the brake 24 and sensor 25 by welding, screwing or any other suitable means.

The securing plates 21L, 21R, each of which comprises an iron plate having a thickness of 25 mm, are fixed to a bed (not shown) or the like by welding, bolting or any other suitable means, and they serve to mechanically secure the brake rod 22, sensor rod 23 and rodless cylinder 1.

The brake rod 22 and sensor rod 23, each of which comprises an iron column having a diameter of 36 mm, are mechanically secured to the securing plates 21L, 21R by welding or bolt-nut connection. The rodless cylinder 1 may be secured to the securing plates 21L, 21R in similar manner.

The brake 24 has at its opposite ends bearings 24L, 24R by means of which it is slidable on and along the brake rod 22, and the brake 24 brakes the table 6a so as to stop it at a selected or desired stroke position. Likewise, the sensor 25 has at its opposite ends bearings 25L, 25R by means of which it is slidable on and along the brake rod 22, and the sensor 25 detects a current stroke position in absolute manner. Detailed construction of the brake 24 and sensor 25 will be described later.

The brake 24 and sensor 25 are both mechanically secured to the table 6a. This allows the table 6a to freely slide along the brake rod 22 and sensor rod 23 between the opposed securing plate 21L, 21R, via these brake 24 and sensor 25. So, the table 6a can make a reciprocating movement linearly in the X-axis direction.

The brake rod 22 and sensor rod 23 mechanically fixed to the securing plates 21L, 21R constitute fixed beams in the cylinder 1, in such a manner that the entire weight of the table 6a is received by the brake rod 22 and sensor rod 23 as the fixed beam. Thus, the rodless cylinder 1 functions solely as an actuator for moving the table 6a in the piston movement direction (X-axis direction) and is not affected by any load. Consequently, as compared with the conventional rodless cylinder apparatus, the rodless cylinder apparatus of this invention shows dramatically increased strength against various moments such as the bending, lateral bending and twisting moments.

The rodless cylinder apparatus of this invention is primarily characterized in that movement in the X-axis direction of the table 6a is controlled by the rodless cylinder 1, a current position of the table 6a is detected by the sensor 25, and the table 6a is stopped at a desired position by the brake 24 in accordance with the detection of its current position.

To stop the table 6a at a desired position by the brake 24, the present invention employs the positioning control technique as disclosed in Japanese Patent Laid-open Publication No. Sho 59-117902. Only outline of the positioning control technique is given herein since it is described in detail in the publication. The positioning control technique is characterized by having a learning control function which permits precise positioning of the table 6a in consideration of the speed or acceleration of the piston 2a (table 6a) or overrun amount corresponding thereto. The positioning control technique performs a positioning control by predicting overrun amount corresponding to the moving speed of the piston 2a, as well as predicting overrun amount in consideration of the acceleration because the initiation time of movement is relatively strongly affected by the acceleration. That is, predicted overrun amount is determined in consideration of both the moving speed and the acceleration of the piston 2a relative to the cylinder tube 1a, and the current position data from the sensor 25 or positioning target value (established value of movement amount) is changed in such a manner that compensation is made in accordance with the predicted overrun amount determined, and movement amount of the piston 2a is controlled on the basis of comparison with the changed position data or positioning target value.

Figure 4:
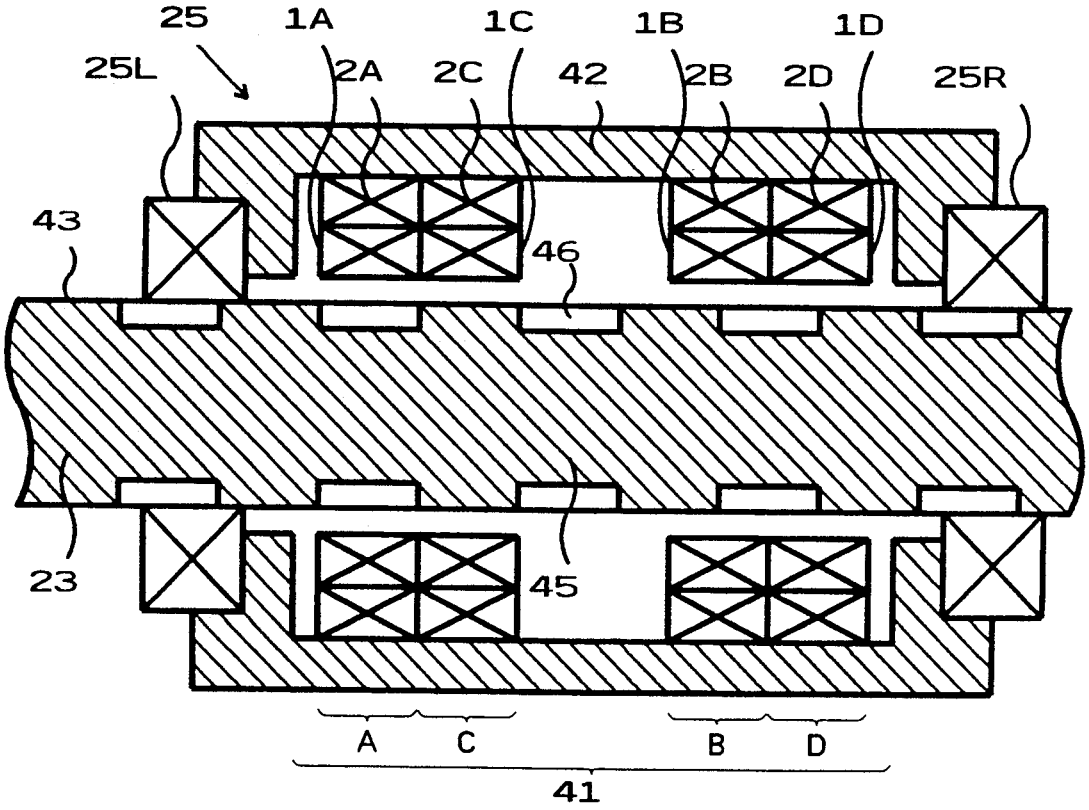
FIG. 4 is a cross-sectional view illustrating in detail the construction of a sensor employed in the rodless cylinder apparatus of the present invention.

FIG. 4 illustrates in detail the construction of the sensor 25 which is an absolute-type position sensor in the form of an induction-type, phase shift-type position sensor. Simplified description on this position sensor will be given herein since detail of it can be known from such as Japanese Utility Model Laid-open Publication Nos. Sho 57-134622, Sho 57-151503, Sho 57-135917, Sho 58-136718 or Sho 59-175105.

The sensor 25 serves to detect a linear position of the sensor rod 23 and comprises a coil assembly 41 and the sensor rod 23. The coil assembly 41 includes four primary coils 1A, 1C, 1B, 1D that are wound around the sensor rod 23 and spaced from each other in the axial direction of the rod 23 at a predetermined interval, and four secondary coils 2A, 2C, 2B, 2D that are disposed in corresponding relation to primary coils 1A, 1C, 1B, 1D. The coil assembly 41 is fixedly accommodated in the casing 42 in such a manner that its internal cylindrical space is concentrical with the sensor rod 23.

The sensor rod 23 comprises a magnetic calibration section 43 formed of a magnetic section 45, and annular non-magnetic sections 46 each of a predetermined width. The annular non-magnetic sections 46 are disposed around the sensor rod 23 and spaced apart from each other in the axial direction of the rod 23 in such a manner that, on the surface of the rod 23, the magnetic section 45 and any of the non-magnetic sections 46 appear in alternating fashion. The magnetic section 45 and non-magnetic sections 46 may be made of any suitable materials as long as they are able to impart a change in magnetic resistance or reluctance to a magnetic circuit produced in the coil assembly 41. For example, the non-magnetic sections 46 may be made of any non-magnetic material or air. Alternatively, the magnetic section 45 and non-magnetic sections 46 having different permeabilities may be formed in alternating fashion, by performing a laser burning on the iron sensor rod 23 to change the magnetic characteristics of the rod 23.

It is assumed here that each of the coils has a length (i.e., length in the axial direction of the rod 23) of P/2 (P is an optional value), and one pitch interval in the row of the magnetic section 45 and non-magnetic sections 46 is P. In this case, the magnetic section 45 and non-magnetic sections 46 may be of an equal length of P/2 or may be of different lengths.

According to this embodiment, the coil assembly 41 is constructed so as to work at four phases which are, for the sake of convenience, denoted in the drawings by reference characters A, C, B and D.

Positional relationship between the sensor rod 23 and coil assembly 41 is such that reluctances produced in the four phases A, C, B, D in correspondence with the position of the sensor rod 23 are different or shifted by 90° from one another in correspondence with the position of the sensor rod 23. For example, when the phase A is a cosine phase, the phase C will be a minus cosine phase, the phase B will be a sine phase, and the phase D will be a minus sine phase.

In the example shown in FIG. 4, pairs of the primary coils 1A, 1B, 1C, 1D and secondary coils 2A, 2C, 2B, 2D are provided respectively for the phases A, C, B, D. The secondary coils 2A, 2C, 2B, 2D are wound outwardly of the corresponding primary coils 1A, 1B, 1C, 1D.

In the illustrated example, each of the primary coils 1A, 1B, 1C, 1D and secondary coils 2A, 2C, 2B, 2D has, as previously noted, a length of P/2. Further, the coils 1A, 2A of the phase A are provided adjacent to the coils 1C, 2C of the phase C, while the coils 1B, 2B of phase B are provided adjacent to the coils 1D, 2D of the phase D. Further, it is assumed that the interval between the coils of the phase A and the coils of the phase B and interval between the coils of the phase C and the coils of the phase D is P ($n \pm \frac{1}{4}$) (n is an optional natural value).

Thus, in accordance with relative linear displacement between the sensor rod 23 and coil assembly 41, reluctance at each of the phases A–D in the magnetic circuit periodically changes in a cycle corresponding to the interval P, with the phases A–D being different or phase shifted by 90° from each other. More specifically, the phases A and C are different by 180° from each other, and the phases B and D are also different by 180° from each other.

Figure 5:
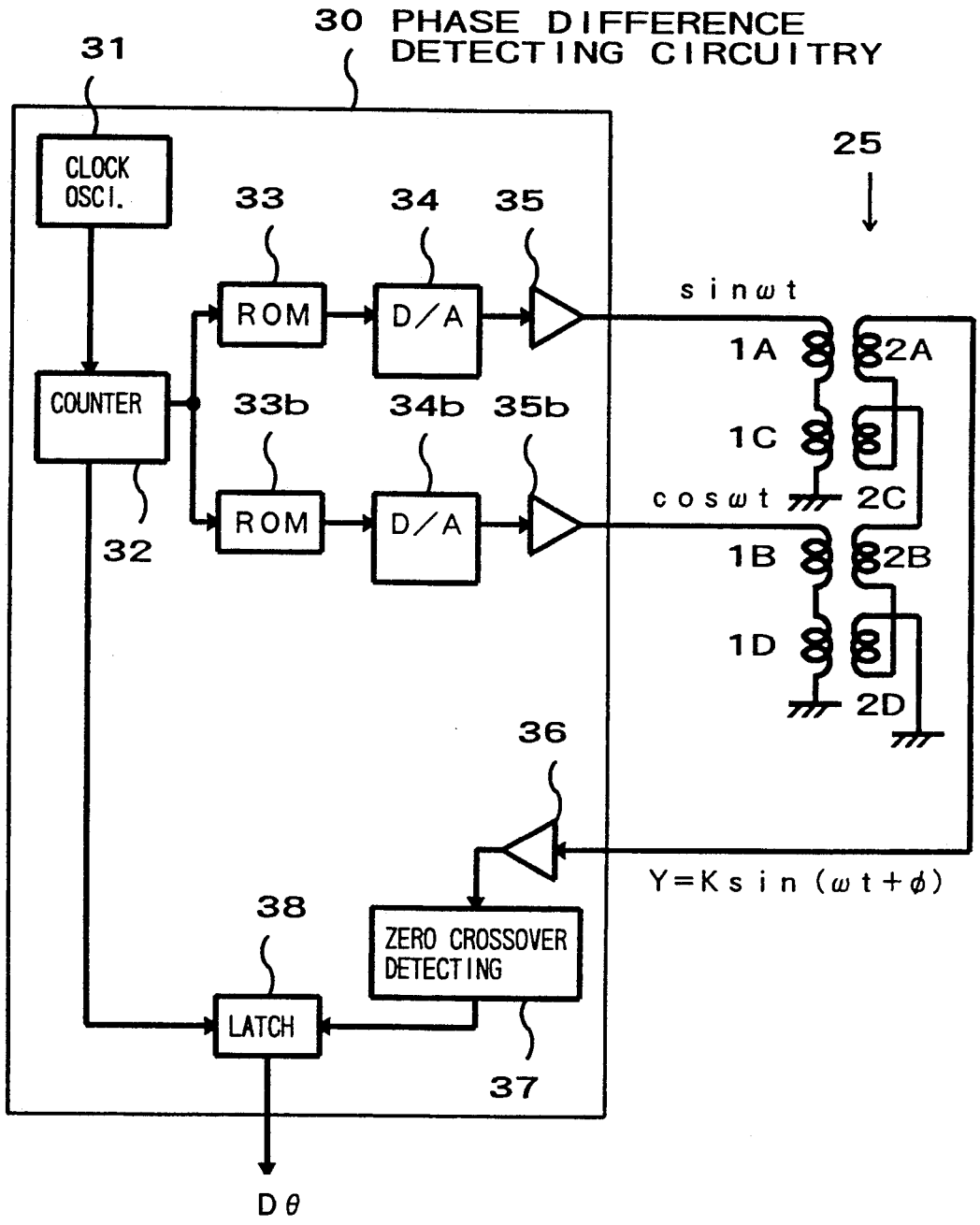
FIG. 5 is a block diagram showing an example circuitry of phase difference detector which is arranged to obtain a phase difference $\phi$ from the sensor unit of FIG. 4 in digital amount.

Connection among the primary coils 1A, 1C, 1B, 1D and secondary coils 2A, 2C, 2B, 2D is shown in FIG. 5. Namely, the connection is such that the primary coils 1A, 1C of the phases A and C are excited at the same phase by sine wave signal sine $\omega t$, and the outputs of the secondary coils 2A, 2C are added together at opposite phase. Similarly, the primary coils 1B, 1D of the phases B and D are excited at the same phase by cosine wave signal cos $\omega t$, and the outputs of the secondary coils 2A, 2C, 2B, 2D are added together at opposite phase. The outputs of the secondary coils 2A, 2C, 2B, 2D are finally added together and provided as an output signal Y to the phase difference detecting circuitry 30.

This output signal Y is such a signal that has been produced from phase-shifting the reference AC signals (sine $\omega t$ and cos $\omega t$) by an phase angle $\phi$ corresponding to relative linear position between the magnetic section 45 of the sensor rod 23 and the sensor 25. That is because the reluctances at the phases A–D are different by 90° from one another, and also the exciting signal for one pair of the phases A and D is different by 90° in electrical phase from that for the other pair of the phases B and D. Therefore, the output signal can be expressed as:

$$Y = K \sin(\omega t + \phi),$$

in which K is a constant.

Phase $\phi$ of the reluctance change is proportional to the linear position of the magnetic portion 45 in accordance with a predetermined proportion coefficient (or a predetermined proportion function), and thus the linear position can be detected by measuring phase shift amount $\phi$ in the output signal Y from the reference signal sine $\omega t$ or cos $\omega t$. However, if the phase shift amount $\phi$ is a full $2\pi$, the linear position will correspond to the above-noted distance P. That is, by measuring the electrical phase shift amount $\phi$, absolute linear positions within the distance P can be precisely detected with considerably high resolution.

It should be understood that the magnetic calibration section 43 of the sensor rod 23 may be made of other materials than magnetic and non-magnetic materials. For example, the magnetic calibration section 43 may comprise combination of materials having different electric conductivities. For example, the magnetic calibration section 43 may comprise a combination of high conductivity material such as copper and low conductivity material such as iron (or non-conductive material) so that there is produced a change in reluctance corresponding to eddy current loss. In such a case, the surface of the sensor rod 23 made of iron or the like may be plated with copper or the like, to form a conductive pattern. The conductive pattern may be of any shapes as long as it can efficiently produce a change of magnetic resistance.

Any suitable construction may be employed for obtaining phase shift amount $\phi$ between the output signal Y and reference signal sin $\omega t$ or cos $\omega t$. FIG. 5 illustrates an example of the phase difference detecting circuitry 30 which is capable of obtaining such phase difference amount $\phi$ in digital amount.

In FIG. 5, the phase difference detecting circuitry 30 generally comprises a reference signal generating section for generating reference AC signals sin $\omega t$ or cos $\omega t$, and a phase difference detecting section for detecting a phase difference (phase shift amount) $D\theta$ between the mutual induction voltages of the secondary coils 2A–2D and the reference signal sin $\omega t$. The reference signal generating section includes a clock oscillator 31, synchronous counter 32, ROMs 33, **33*b*, D/A converters 34, 34*b* and amplifiers 35, 35*b*. The phase difference detecting section includes an amplifier 36, zero crossover detecting and latch circuit 38**.

In the reference signal generating section, the clock oscillator 31 produces rapid and accurate clock signals, in accordance with the other elements are caused to operate. The synchronous counter 32 counts the clock signals produced from the clock oscillator 31 and provides the counted value to the ROM 33 as an address signal as well as to the latch 38.

The ROMs 33, **33*b* store amplitude data corresponding to the reference ac signals; that is, the ROM 33 stores amplitude data of sin $\omega t$, and the ROM 33*b* stores amplitude data of cos $\omega t$. Each of the ROMs 33, 33*b* is responsive to the address signal (counted value) from the counter 32 for producing an amplitude data of the corresponding reference AC signal. More specifically, the ROMs 33, 33*b* receive the same address signal from the counter 32**, in response to which they output two kinds of reference AC signals sin $\omega t$ and cos $\omega t$. Alternatively, the two kinds of reference AC signals sin $\omega t$ and cos $\omega t$ may be produced by reading out the same ROM with address signals of different phases.

The D/A converters 34 and **34*b* convert the digital amplitude data from the corresponding ROMs 33 and 33*b* into analogue signals and provide these analogue signals to the amplifiers 35 and 35*b*. The amplifiers 35 and 35*b* in turn amplify the analogue signals and provide, as the reference ac signals sin $\omega t$ and cos $\omega t$, the amplified analogue signals to the primary coils 1A–1D. If the frequency division number is M, then the counted value of M corresponds to the maximum phase angle $2\pi$ radian (360° ) of the reference AC signal; that is, one count of the counter 32** indicates a phase angle of $2\pi/M$.

In the phase difference detecting section, the amplifier 36 amplifies the sum of secondary voltages induced in the secondary coils 2A–2D and outputs the amplified sum to the zero crossover detecting circuit 37. Based on the mutual voltages (secondary voltages) induced in the secondary coils 2A–2D, the zero crossover circuit 37 detects a zero crossover point where negative voltage changes to positive voltage and outputs a zero crossover detection signal to the latch circuit 38. Thus, upon receipt of the zero crossover detection signal (namely, upon detection of a zero crossover point), the latch circuit 38 latches the count of the counter 32 which has initiated counting in response to a clock signal defining the rise of the reference AC signals. Accordingly, the value latched in the latch circuit 38 accurately indicates the phase difference (phase shift amount) $D\theta$ between the reference ac signals and the mutual induction voltage (composite secondary output). A current position in the entire stroke of the piston 2*a* can be detected on the basis of this phase difference $D\theta$.

Figure 6:
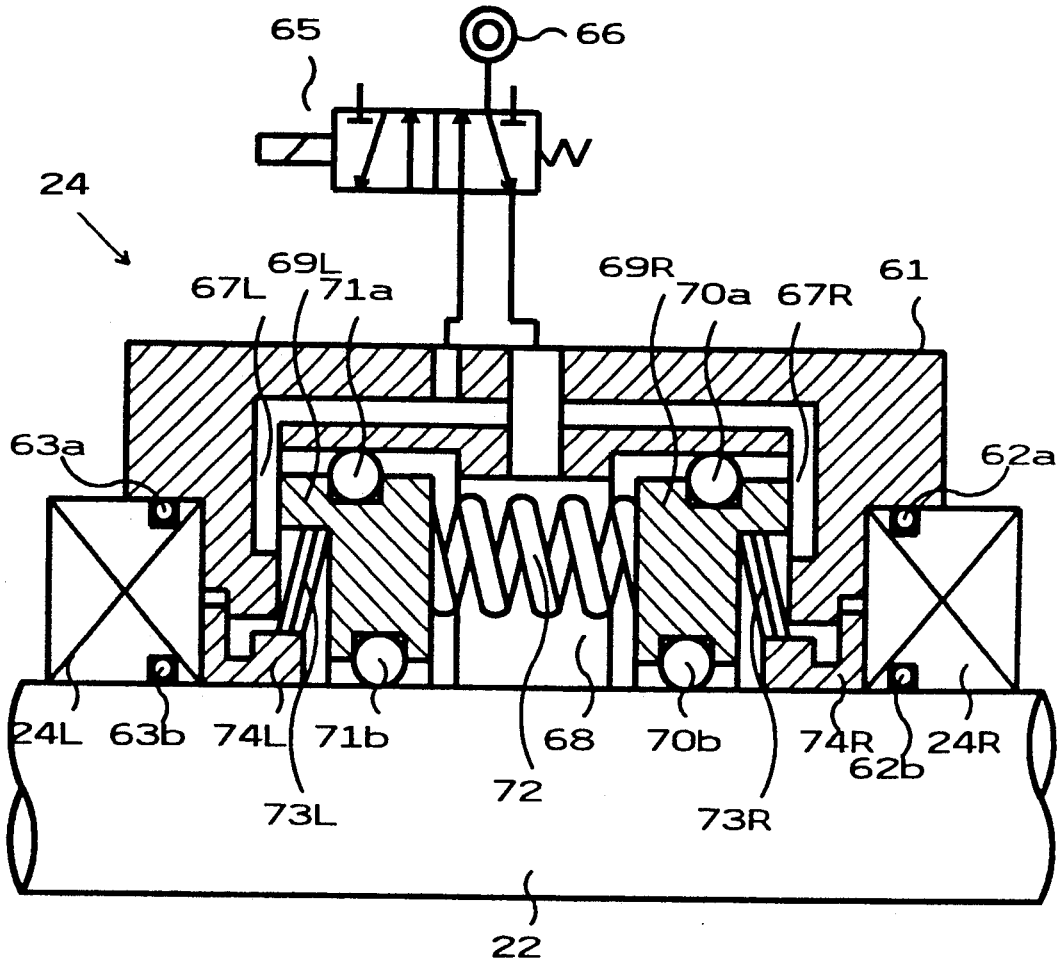
FIG. 6 is a cross-sectional view schematically showing the construction of a brake employed in the rodless cylinder apparatus of the present invention.

FIG. 6 illustrates the construction of the brake 24 which is in the form of a pneumatic brake mechanism. The cylindrical casing 61 is provided around the brake rod 22. The bearings 24L, 24R are provided at opposite ends of the casing 61 in such a manner that they are slidable on and along the brake rod 22 in the axial direction of the rod 22. The bearings 24L, 24R contain packing members 62*a*, 62*b* and 63*a*, 63*b* respectively for maintaining airtightness within the casing 61.

Within the casing 61, several pipes are provided for supplying pressurized air from the air pressure source 66 via the electromagnetic valve 65 to the air chambers 67L, 67R and 68. The brake pistons 69L, 69R are in contact with the casing 61 via the packing members 70*a*, 71*a* and also in contact with the brake rod 22 via the packing members 70*b*, 71*b* in such a manner that they are slidable on and along the brake rod 22 in the axial direction of the rod 22. Further, the brake pistons 69L, 69R cooperate with the casing 1 for forming the air chambers 67L, 67R and 68. In the air chamber 68 formed between the brake pistons 69L, 69R, plurality of coil springs 72 are provided around the brake rod 22. The coil springs 72 extend between the brake pistons 69L, 69R and act to resiliently push the pistons 69L, 69R outwardly, i.e., apart from each other.

Each of the brake bushes 74L, 74R is a C-shaped bush provided around the brake rod 22 and is freely movable along the rod 22 in the normal state in which no external force is applied.

Coned dish springs 73L, 73R are provided around the respective brake bushes 74L, 74R. The inner circumferential edges of the springs 73L, 73R are in contact with the outer surface of the respective bushes 74L, 74R, while the outer circumferential edges of the springs 73L, 73R are in contact with the inner surface of the respective brake pistons 69L, 69R. With such arrangements, as the distances between the brake bushes 74L, 74R and the brake pistons 69L, 69R become smaller, the coned dish springs 73L, 73R are progressively widened at their outer circumferential edge portions to apply radially inward forces to the brake bushes 74L, 74R. Thus, the brake bushes 74L, 74R are radially inwardly compressed to firmly engage the brake rod 22, in order to effect braking. After that, as the distances between the brake bushes 74L, 74R and the brake pistons 69L, 69R become greater, the coned dish springs 73L, 73R are progressively restored to its original or normal state to eliminate the compressional forces from the bushes 74L, 74R. Thus, the brake bushes 74L, 74R disengage the brake rod 22 to stop braking.

When the air pressure source 66 is in the off-state, namely, not being activated, the brake pistons 69L, 69R are resiliently pushed apart from each other by the coil spring 72, and the coned dish springs 73L, 73R are pressed against the inner surface of the casing 61 via the brake pistons 69L, 69R. The inner diameters of the coned dish springs 73L, 73R thus pressed cause the brake bushes 74L, 74R to be pressed against the brake rod 22. Thus, the brake 24 is maintained in the braking state by the frictional force between the brake bushes 74L, 74R and the brake rod 22. Therefore, even when the air pressure source 66 is in the off-state, the brake 24 can be maintained in self-locking state (braking state).

When the air pressure source 66 is in the on-state, namely, is being activated, braking function by the brake 24 is controlled by on/off of the electromagnetic valve 65. When the electromagnetic valve 65 is in the off-state as shown in FIG. 6, pressurized air is introduced from the source 66 into the air chamber 68, and the air chambers 67L, 67R are exposed to the external atmosphere. Thus, the brake pistons 69L, 69R which are, as previously noted, normally pushed by the resilient force of the coil springs 72 are even more strongly pushed outwardly away from each other by additional high pressure of the introduced pressurized air. Accordingly, the coned dish springs 73L, 73R are pressed against the inner surface of the casing 61 with much greater force than when the air pressure source 66 is in the off-state, and hence the brake 24 is able to provide a greater braking force.

On the other hand, when the electromagnetic valve 65 is in the on-state, pressurized air is introduced from the source 66 into the air chambers 67L, 67R, and the air chamber 68 is exposed to the external atmosphere. Thus, high pressure of the introduced pressurized air acts to reduce the resilient force of the coil springs 72, so that the brake pistons 69L, 69R are moved inwardly toward each other against the bias of the coil springs 72. This eliminates the pressing force applied to the coned dish springs 73L, 73R, so that the brake bushes 74L, 74R disengage the brake rod 22. In this way, the braking force by the brake 24 is eliminated, and the brake bushes 74L, 74R are free to move along the brake rod 22.

In the preferred embodiment so far described, one brake 24 and one sensor 25 are provided on their respective rods. However, one brake 24 may be provided on each of the two rods, with the sensor 25 being provided on either of the rods. Alternatively, the brake 24 and sensor 25 may be provided on the same rod. Further, a rod may be provided within the cylinder tube to support thereon the piston and piston yoke in such a manner that the piston and piston yoke can move in the axial direction of the rod. The brake and sensor may be provided in the piston yoke.

Moreover, it is a matter of course that the brake may be of a mechanical type or any other types than the pneumatic type as described above.

Although the rodless cylinder 1 has been described as being secured at opposite ends to the securing plates 21L, 21R, the rodless cylinder 1 need not be secured directly to the securing plates 21L, 21R, as long as the brake rod 22 and sensor rod 23 form beams between the plates 21L, 21R and the rodless cylinder 1 is mounted in such a manner that the table can move along the rods. Namely, the rodless cylinder 1 may be fixedly connected with each rod 22, 23 in relative manner via securing plate etc.

Figure 9:
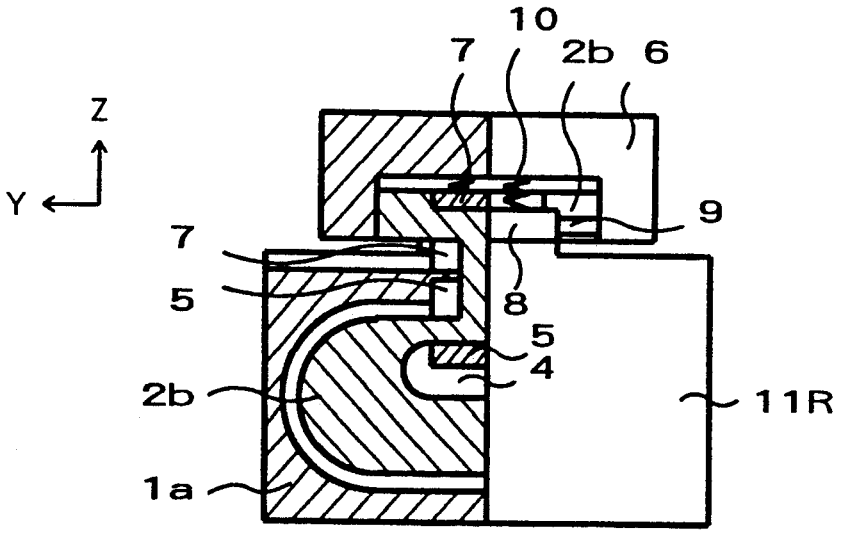
(PRIOR ART) F I G. 9
FIG. 9 is an end view of the prior art rodless cylinder apparatus as viewed in the X-axis direction.
Figure 7:
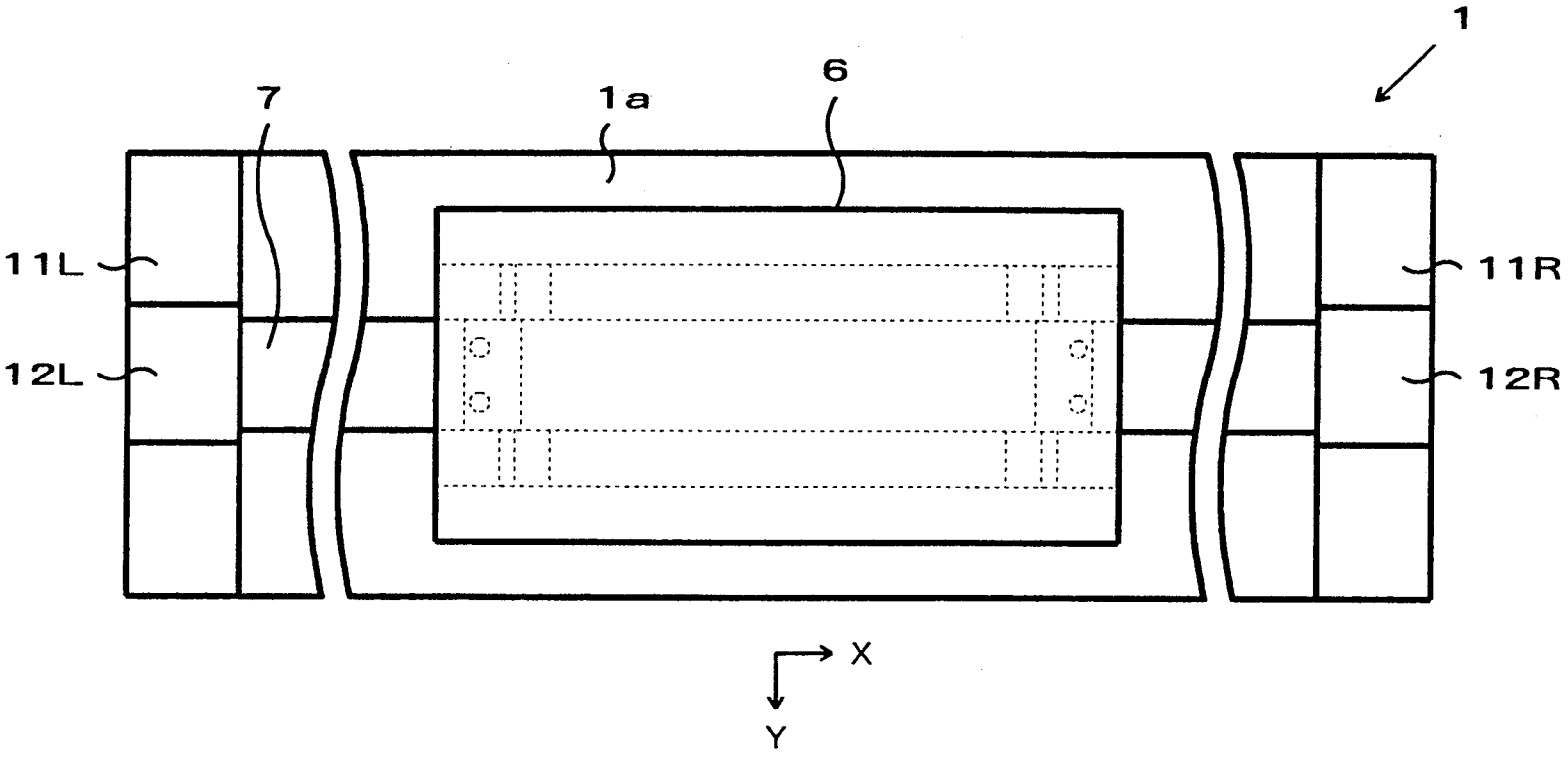
FIG. 7 (PRIOR ART)
FIG. 7 is a top plan view of an example of a prior art rodless cylinder apparatus as viewed in the Z-axis direction.
Figure 8:
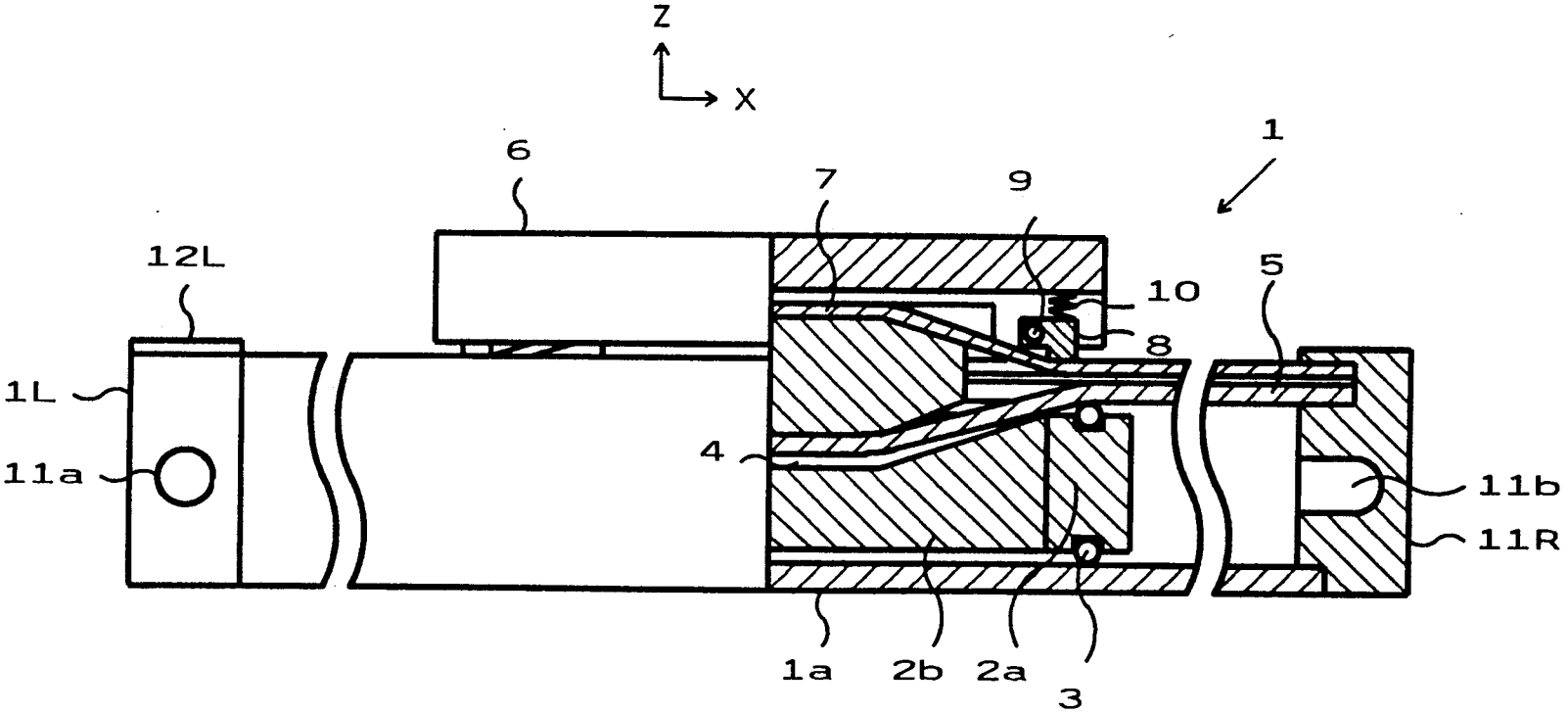
FIG. 8 (PRIOR ART)
FIG. 8 is a side elevational view of the prior art rodless cylinder apparatus as viewed in the Y-axis direction.

Further, the rodless cylinder apparatus of the present invention may of course be realized by using a rodless cylinder other than that illustrated in FIGS. 7 to 9. Although the brake rod and sensor rod have been described as being exposed to the external environment, the entire rodless cylinder apparatus may be accommodated in a casing to be protected from dust in the external environment. In addition, a plurality of the rodless cylinder apparatuses of the invention may be employed to provide a robot which can freely move in two or three-dimentional coordinate space in controlled manner. In this case, it suffices only to interconnect the tables of the respective cylinder apparatuses forming the X-axis and Y-axis.

With the arrangements so far described, the rodless cylinder of the invention can have a greatly increased rigidity against external load, and also is capable of easily positioning the piston to stop accurately at a desired position in its stroke.

What is claimed is:

1. A rodless cylinder apparatus for positioning an article carrier at a selected position which comprises:

a rodless cylinder including a cylinder tube, a piston movable within said cylinder tube and a connecting member connected to said piston, said cylinder tube having a longitudinal gap extending in an axial direction thereof, through which said connecting member projects outwardly of the cylinder so as to connect the carrier with said piston and is also allowed to move along said cylinder tube in such a manner that the carrier is moved together with said piston;

at least a first rod fixed relative to said cylinder tube to extend in parallel with a direction in which said piston moves within said cylinder tube, said rod being provided in such a manner to support at least a part of weight of the carrier applied to said rodless cylinder; and sensor means having a moving member movable along said rod as said piston moves within said cylinder tube, for detecting a current position of said piston in accordance with relative positional relation between the moving member and the rod, said sensor means further comprising a coil section provided in said moving member and including at least a primary coil to be excited by a predetermined AC reference signal, a magnetic calibration section provided in said rod in the axial direction thereof in such a manner that reluctance in a magnetic circuit formed by said coil section is caused to change with movement of said moving member, and position detecting means capable of producing data indicative of a position of said piston, on the basis of a reluctance change in the magnetic circuit that occurs in accordance with relative positional relationship between said magnetic calibration section and said coil section.

2. A rodless cylinder apparatus as defined in claim 1, which further comprises brake means movable along said rod as said piston moves within said cylinder tube and is capable of braking said piston by frictional force produced between said brake means and said rod.

3. A rodless cylinder as defined in claim 2, which further comprises a second rod, and wherein said brake means is provided to be movable along at least one of said first and second rods.

4. A rodless cylinder as defined in claim 2, wherein said brake means is a pneumatic brake that includes a brake bush provided around said rod, a spring pressing said brake bush against said rod, and a brake piston movable along said rod in accordance with a change in pneumatic pressure applied thereto to thereby deform said spring.

5. A rodless cylinder as defined in claim 1, wherein said rod is provided outside said cylinder tube to slidably support said carrier.

6. A rodless cylinder as defined in claim 1, wherein said rod is provided within said cylinder tube to slidably support said piston.

7. A rodless cylinder as defined in claim 1, wherein said rod is constructed in such a manner to support said part of weight of the carrier applied via said moving member of said sensor means.

8. A rodless cylinder apparatus for positioning an article carrier at a selected position which comprises:

a rodless cylinder including a cylinder tube, a piston movable within said cylinder tube and a connecting member connected to said piston, said cylinder tube having a longitudinal gap extending in an axial direction thereof, through which said connecting member projects outwardly of the cylinder so as to connect the carrier with said piston and is also allowed to move along said cylinder tube in such a manner that the carrier is moved together with said piston;

at least a first rod fixed relative to said cylinder tube to extend in parallel with a direction in which said piston moves within said cylinder tube, said rod being provided in such a manner to support at least a part of weight of the carrier applied to said rodless cylinder;

sensor means having a moving member movable along said rod as said piston moves within said cylinder tube, for detecting a current position of said piston in accordance with relative positional relation between the moving member and the rod; and brake means movable along said rod as said piston moves within said cylinder tube and is capable of braking said piston by frictional force produced between said brake means and said rod, said brake means being a pneumatic brake which includes a brake bush provided around said rod, a spring pressing said brake bush against said rod, and a brake piston movable along said rod in accordance with a change in pneumatic pressure applied thereto to thereby deform said spring.

* * * * *